US008549794B2

(12) United States Patent
Hotes

(10) Patent No.: US 8,549,794 B2
(45) Date of Patent: Oct. 8, 2013

(54) SHADE SHELTERS AND SYSTEMS AND METHODS THEREFOR

(75) Inventor: Doug Hotes, Kirkland, WA (US)

(73) Assignee: California Industrial Facilities Resources, Inc., Kirkland, WA (US)

( * ) Notice: Subject to any disclaimer, the term of this patent is extended or adjusted under 35 U.S.C. 154(b) by 0 days.

(21) Appl. No.: 13/294,979

(22) Filed: Nov. 11, 2011

(65) Prior Publication Data

US 2013/0118095 A1 May 16, 2013

(51) Int. Cl.
*E04B 1/12* (2006.01)

(52) U.S. Cl.
USPC ..... 52/63; 135/156

(58) Field of Classification Search
USPC ..... 52/3, 23, 2.16, 63; 135/156, 120.1, 135/113
See application file for complete search history.

(56) References Cited

U.S. PATENT DOCUMENTS 2,492,258 A * 12/1949 Berg ..... 219/385
3,158,457 A * 11/1964 Whitfield ..... 55/472
3,970,096 A * 7/1976 Nicolai ..... 135/94
4,067,347 A * 1/1978 Lipinski ..... 126/624
4,102,352 A * 7/1978 Kirkham ..... 135/97
4,354,091 A * 10/1982 Bain ..... 219/213
4,819,389 A * 4/1989 Kihn ..... 52/2.21
5,033,493 A * 7/1991 Senchuck ..... 135/149
5,316,541 A * 5/1994 Fischer ..... 600/21
5,398,678 A * 3/1995 Gamow ..... 128/205.26
5,566,512 A * 10/1996 Page ..... 52/2.16
5,638,850 A * 6/1997 Hazinski et al. ..... 135/120.1
6,463,948 B2 * 10/2002 Lee ..... 135/156
6,554,013 B2 * 4/2003 Brown ..... 135/93
6,606,826 B2 * 8/2003 Nagle ..... 52/2.18
6,679,009 B2 1/2004 Hotes

* cited by examiner

*Primary Examiner* — Basil Katcheves
(74) *Attorney, Agent, or Firm* — Christensen O'Connor Johnson Kindness PLLC

(57) ABSTRACT

Shade shelters for reducing air conditioning loads of an associated shelter are provided. The shade shelters aim to reduce the thermal radiation effects of the sun on associated shelters, such as temporarily erected shelters. The shade shelters can be configurable so that natural convection is advantageously utilized for aiding in reducing heat transfer into the interior space of the associated shelter. The natural convection can be in the form of the "chimney effect" for reducing heat transfer into the interior space of the shelter.

21 Claims, 7 Drawing Sheets

SHADE SHELTERS AND SYSTEMS AND METHODS THEREFOR

BACKGROUND

Portable shelters are commonly used by the U.S. military and others, and are occupiable for temporarily housing military or other personnel, equipment, and/or supplies, or for providing services such as cooking, dining or medical care. Ideally, such shelters should be designed for storage in a compact configuration that can be easily transported to a new destination for assembly. Preferably, the assembly and disassembly process should be relatively quick and easy and require few hand tools.

For military and sometimes other uses, such shelters may be used in hot external environments. In that regard, some temporary shelters employ air conditioners to condition the interior space thereof. As known in the art, air conditioners are large users of power. Such power is usually generated by fuel-powered generators due to the portable nature of the shelters and the remote locations where these shelters find their primary use. Also known in the art, the fuel to operate the generators is quite expensive to purchase and/or transport in such remote locations.

Therefore, there is a need in the portable shelter industry to reduce the amount of power, and the associated expense, needed to cool the interior spaces of portable shelters in hot external environments.

SUMMARY

To address the aforementioned need and others, several embodiments of the present disclosure aim to reduce the air conditioning loads needed to maintain the interior spaces of shelters at comfortable ambient temperatures in the presence of hot external environments. Reducing air conditioning loads can result in reducing the power required to operate the air conditioners, including reduced cycle times or the ability to employ smaller capacity air conditioners. Reducing the power required to operate these air conditioners leads to a reduction in fuel needed to operate the generators.

In accordance with aspects of the present disclosure, a system is provided, which comprises a shelter including a roof, a plurality of side walls, and an enclosed interior space, and a portable shade shelter positioned a spaced distance over at least a portion of the shelter so as to create a space between an inner surface of the shade shelter and an outer surface of the shelter. In one embodiment, the shade shelter includes a plurality of solid side walls, a solid roof covering at least a portion of the roof of the shelter, and a vent disposed in the solid roof of the shade shelter for allowing gas flow from the space between the outer surface of the shelter and the inner surface of the shade shelter to an area exteriorly of the roof of the shade shelter.

In accordance with another aspect of the present disclosure, a system is provided, comprising a shelter including a roof, a plurality of side walls, and an enclosed interior occupiable space, and a shade shelter supported a spaced distance over at least a portion of the shelter. In one embodiment, the shade shelter includes a frame and a solid outer cover supported by at least a majority of the frame, which together form a plurality of side walls and a roof covering at least a portion of the roof of the shelter. The system may further include a passageway that extends between the shade shelter and the shelter, wherein the solid outer cover in one embodiment includes a section of mesh positioned at or near the apex of the roof. The section of mesh acts as a vent so as to allow gas flow from the passageway to an area exteriorly of the roof of the shade shelter.

In accordance with another aspect of the present disclosure, a method is provided for reducing the air conditioning loads of a shelter. The method comprises obtaining a shelter that includes a roof, two or more side walls, an enclosed interior occupiable space, and at least one air conditioner configured for conditioning the enclosed interior occupiable space, and erecting a portable shade shelter a spaced distance over at least a portion of the shelter so as to create a space between an inner surface of the shade shelter and an outer surface of the shelter. In one embodiment, the shade shelter includes a plurality of side walls supportable by a surface, a roof contiguously associated with the plurality of side walls; and a vent disposed in the roof so as to provide gas flow communication between the space and an area exteriorly of the roof of the shade shelter.

In accordance with yet another aspect of the present disclosure, a portable shade shelter is provided. The portable shade shelter comprises a plurality of side walls supportable by a surface, a roof contiguously associated with the plurality of side walls, and a vent disposed in the roof so as to provide gas flow communication between the space and an area exteriorly of the roof of the shade shelter.

This summary has been provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this disclosure will become more readily appreciated as the same become better understood by reference to the following detailed description, when taken in conjunction with the accompanying drawings, wherein.

DETAILED DESCRIPTION

The detailed description set forth below in connection with the appended drawings where like numerals reference like elements is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed. Similarly, any steps described herein may be interchangeable with other steps, or combinations of steps, in order to achieve the same or substantially similar result.

The following discussion provides one or more examples of shade shelters for reducing air conditioning loads of an associated shelter. In some embodiments, the shade shelter reduces the thermal radiation effects of the sun on the associated shelters. By blocking the sun's rays to a significant degree, the outer surface temperature of associated shelter is reduced, which results in less heat transfer into the interior space thereof. In other embodiments, natural convection is advantageously used to aid in reducing heat transfer into the interior space of the associated shelter. Several embodiments, as will be described in more detail below, employ natural convection known as the chimney effect to reduce heat transfer into the interior space of the associated shelter. Such reduction of heat transfer into the interior space reduces the air conditioning load needed to maintain the interior space of the associated shelter at ambient temperatures of, for example, 76-84 degrees Fahrenheit among others.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. Further, it will be appreciated that embodiments of the present disclosure may employ any combination of features described herein.

Figure 1:
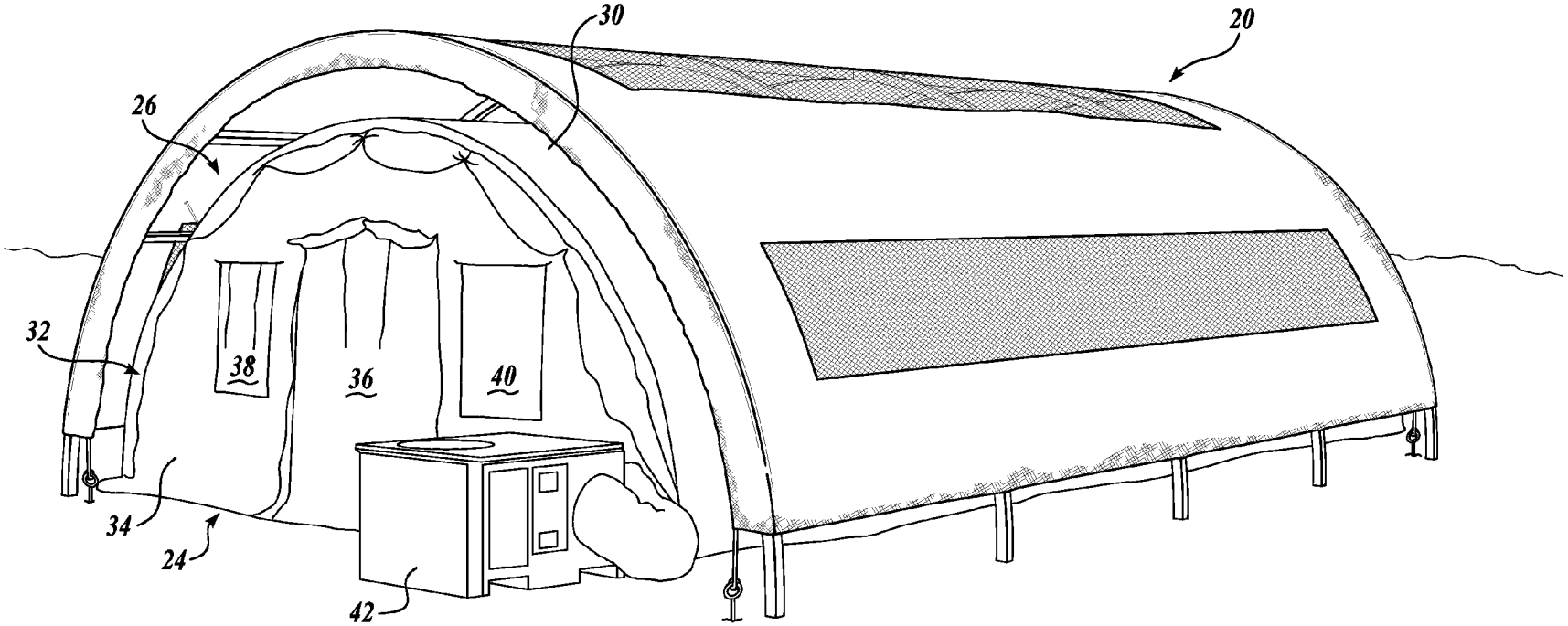
FIG. 1 is a perspective view of one example of a shade shelter formed in accordance with aspect of the present disclosure, the shade shelter shown as erected over a temporary shelter.

Referring now to FIGS. 1-4, there is shown an example of a shade shelter, generally designated 20, formed in accordance with aspects of the present disclosure. As best shown in FIG. 1, the shade shelter 20 is erected over an associated shelter 24, such as a temporary, portable shelter, which in some embodiments employs one or more air conditioners 42 to regulate the temperature of the interior space therein. As will be described in more detail below, the shade shelter 20 is sized and configured so as form a space 26 between the shelter 24 and the shade shelter 20 when erected over the shelter 24 to allow airflow therein.

In use, as will be described in more detail below, the shade shelter 20 blocks a majority of the suds light from hitting the shelter 24, thereby reducing the outer surface temperature of the shelter 24, which in turn, lowers the heat transfer into the interior space thereof. In some embodiments, as will be described in more detail below, the shade shelter 20 is configured and arranged in such a manner so as to induce a chimney effect around the exterior of the shelter 24. As a result, heat transfer into the interior space of the shelter may be reduced. Such reduction of heat transfer into the interior space reduces the air conditioning load needed, or may avoid the need for air conditioning altogether, to maintain the interior space of the shelter at ambient temperatures of, for example, 76-84 degrees Fahrenheit among others.

Figure 7:
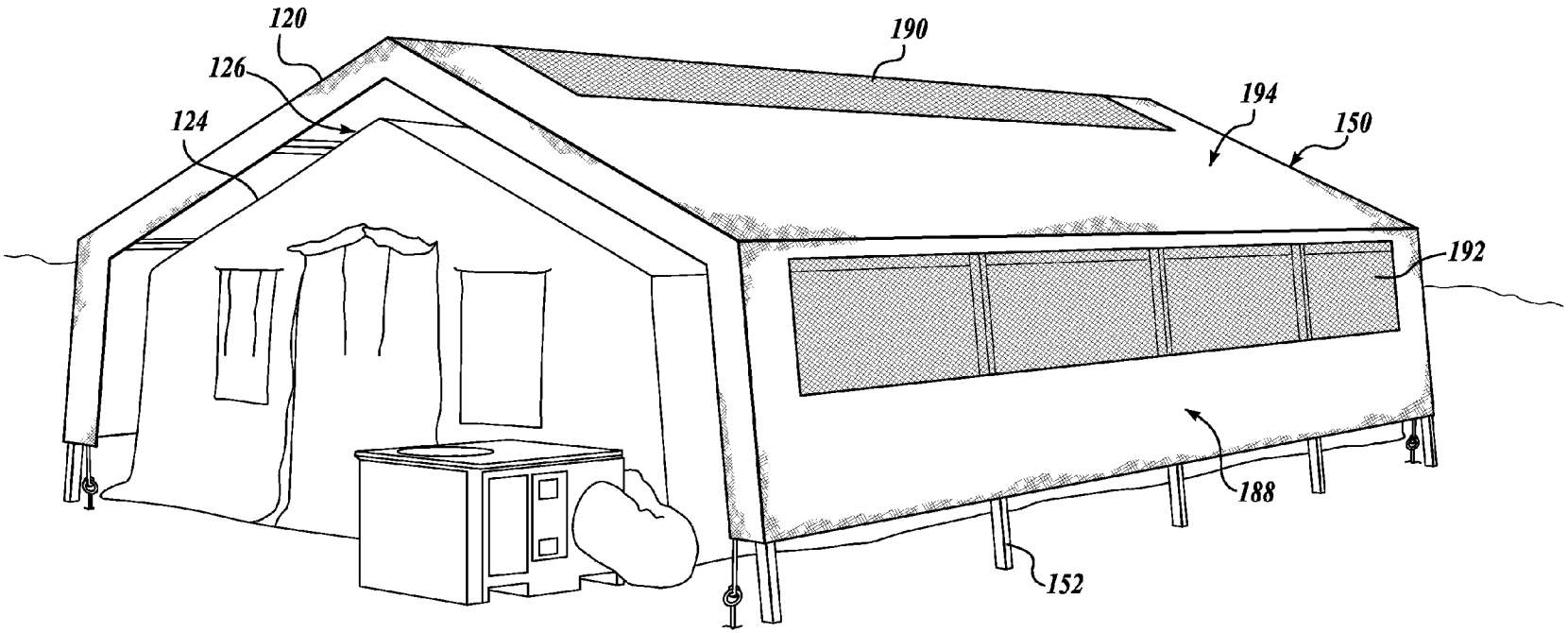
FIG. 7 is a perspective view of another example of a shade shelter formed in accordance with aspect of the present disclosure, the shade shelter shown as erected over another example of a temporary shelter.

One example of the shelter 24 that may be practiced with one or more embodiments of the present disclosure is shown in FIG. 1. In the embodiment shown, the shelter is of the compact and portable type, and comprises a lightweight, easy-to-assemble frame (hidden in FIG. 1) covered with a durable, flexible, outer cover 30 and two opposite end walls (only end wall 32 covered with end wall covers 34 is shown in FIG. 1). In the embodiment shown, the frame is arched and includes a plurality of lightweight arched frame supports attached at their opposite ends to a square or rectangular-shaped base (hidden in FIG. 1). The arched frame supports extend transversely over the base and may be formed from a plurality of curved components connected end-to-end. The arched frame supports are vertically aligned and equally spaced apart over the base and interconnected with adjacent arched frame supports by horizontally aligned purlins. For more detail regarding one example of a shelter that may be employed in embodiments herein, please see U.S. Pat. No. 6,679,009, entitled "Compact, All-Weather Shelter," the disclosure of which is hereby incorporated by reference. Of course, other temporary and permanent shelters of various shapes may be used, one example of which is shown in FIG. 7 and generally designated 124.

In the embodiment shown in FIG. 1, the shelter 24 includes a door 36, flank by windows 38 and 40 in the end wall cover 34. The shelter 24 also includes one or more window openings (hidden in FIG. 1) disposed along the longitudinal sides of the outer cover 28. As best shown in FIG. 1, the shelter 24 may further include an air conditioner 42 and associated components for conditioning the interior space of the shelter 24. It will be appreciated that the interior space of the shelter 24 may be occupied by machines, equipment, supplies, etc., occupied by people for sleeping, dining, office, or medical use, etc., and/or the like.

Figure 2:
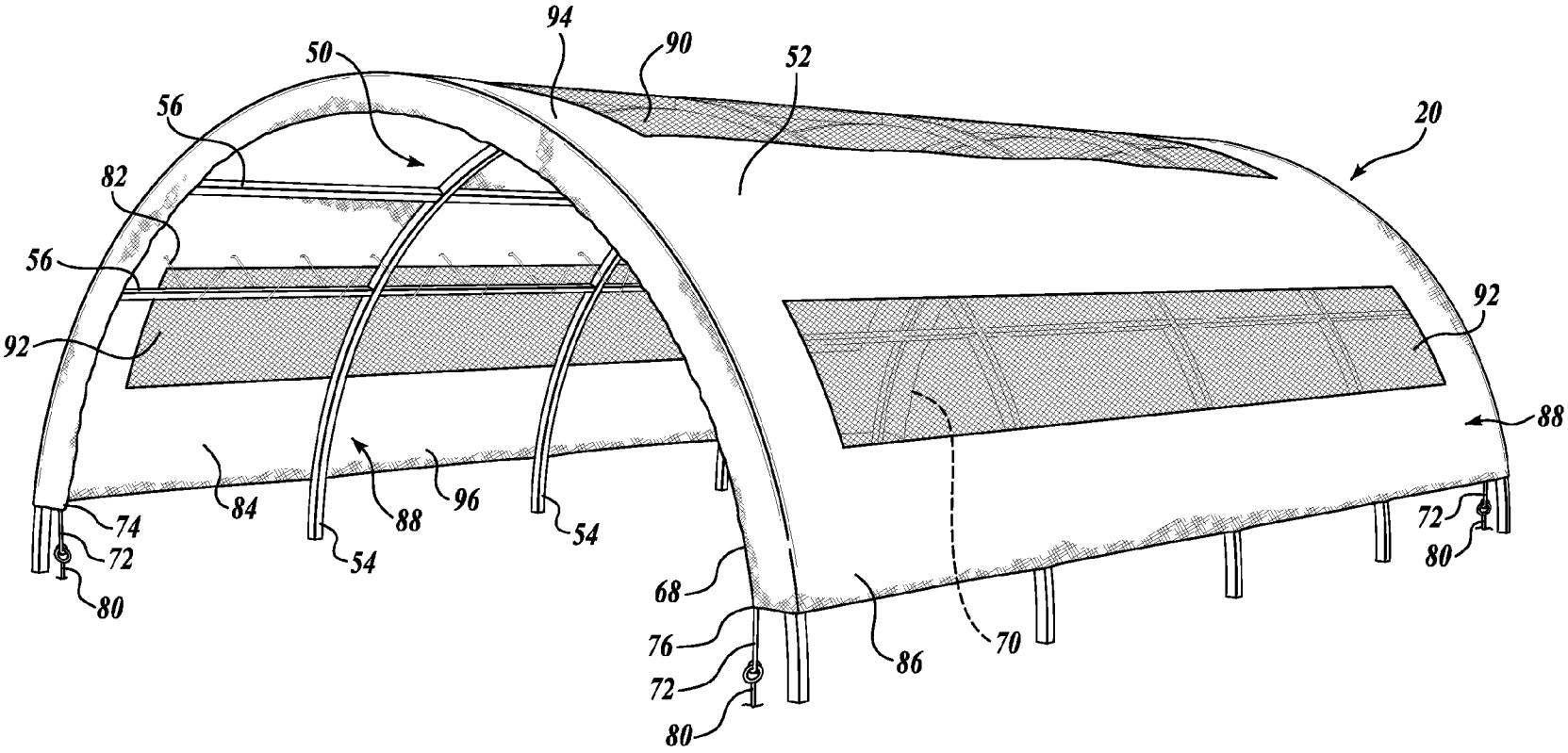
FIG. 2 is a perspective view of the shade shelter of FIG. 1.
Figure 3:
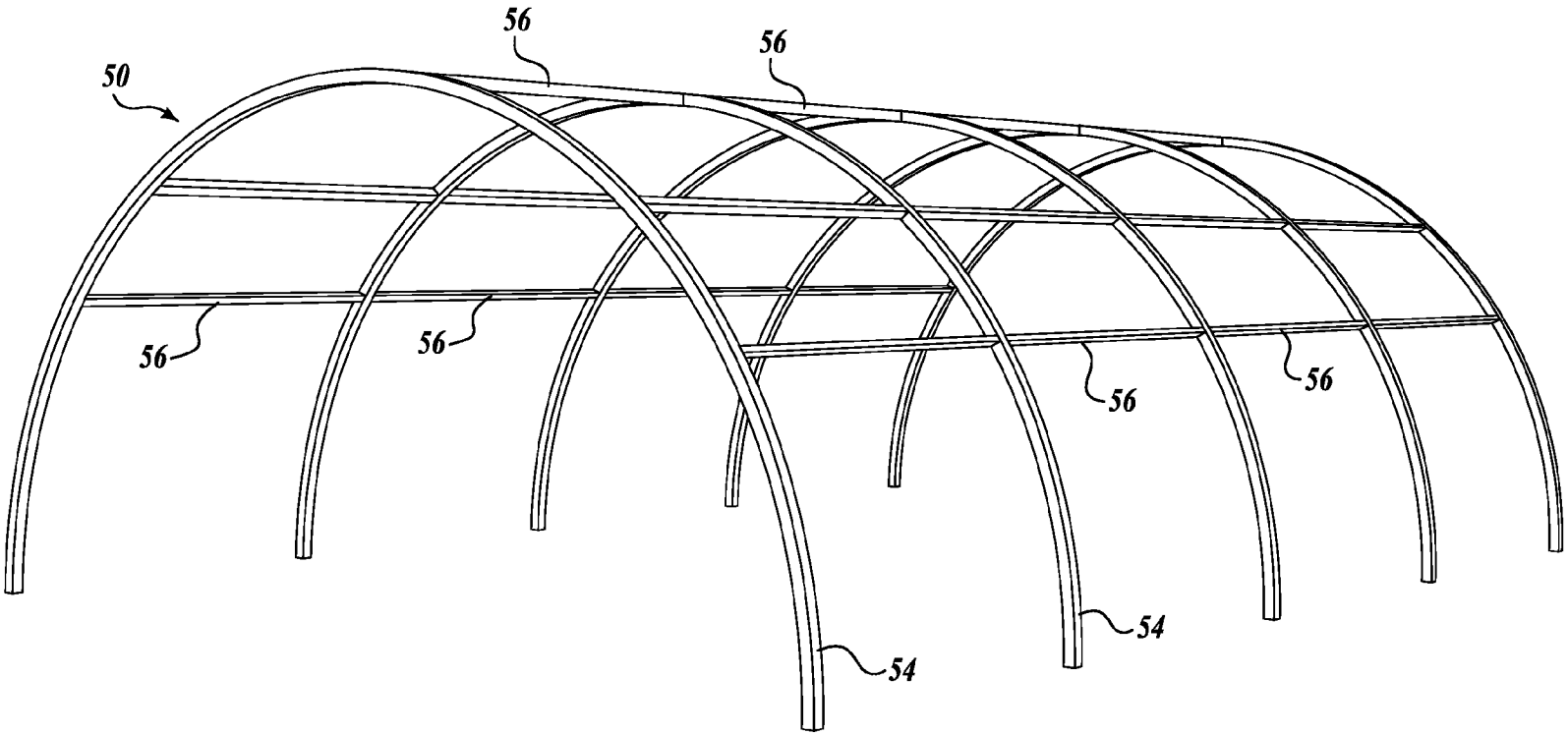
FIG. 3 is one example of a frame of the shade shelter of FIG. 2.
Figure 4:
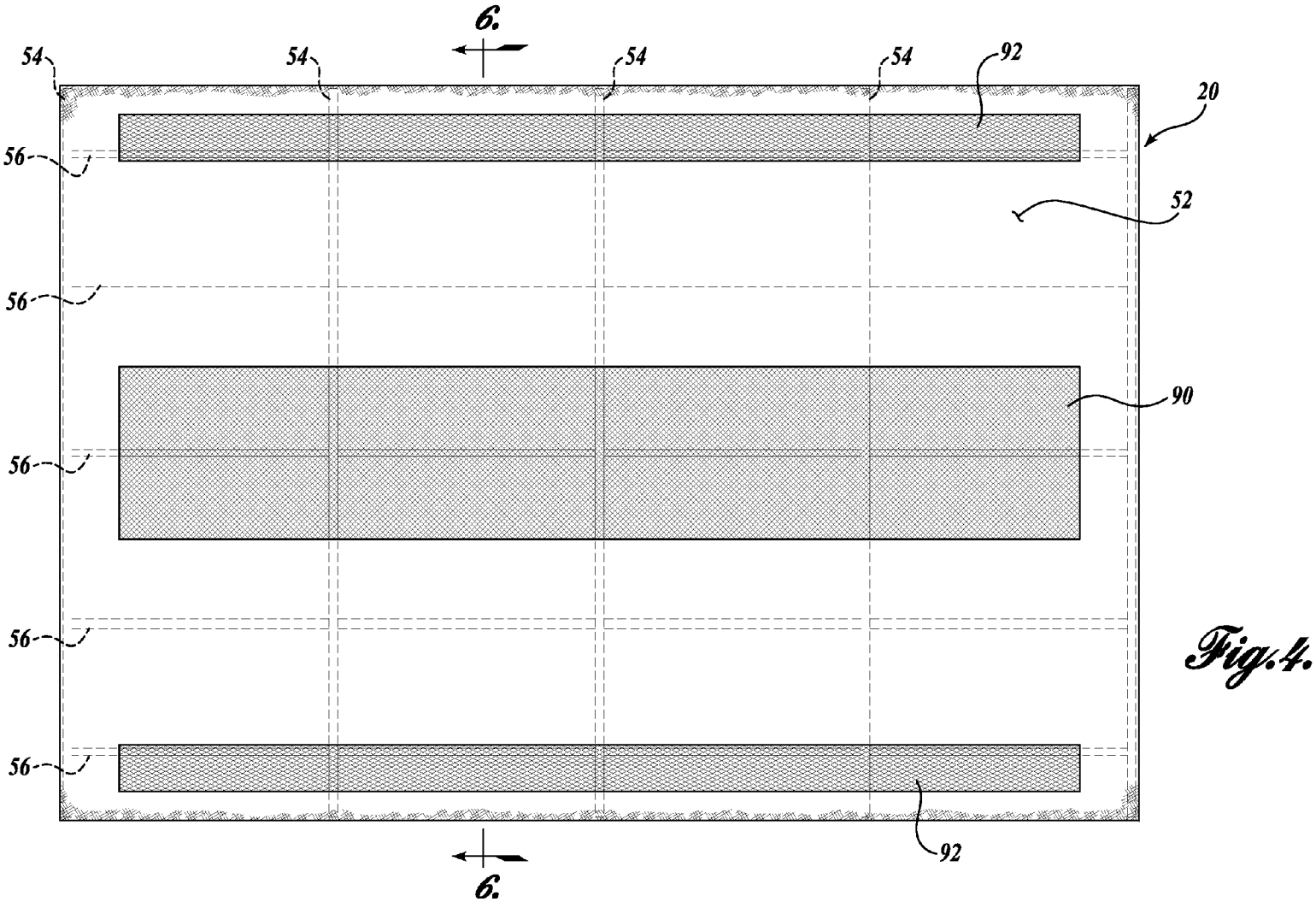
FIG. 4 is a top view of the shade shelter of FIG. 2.
Figure 5:
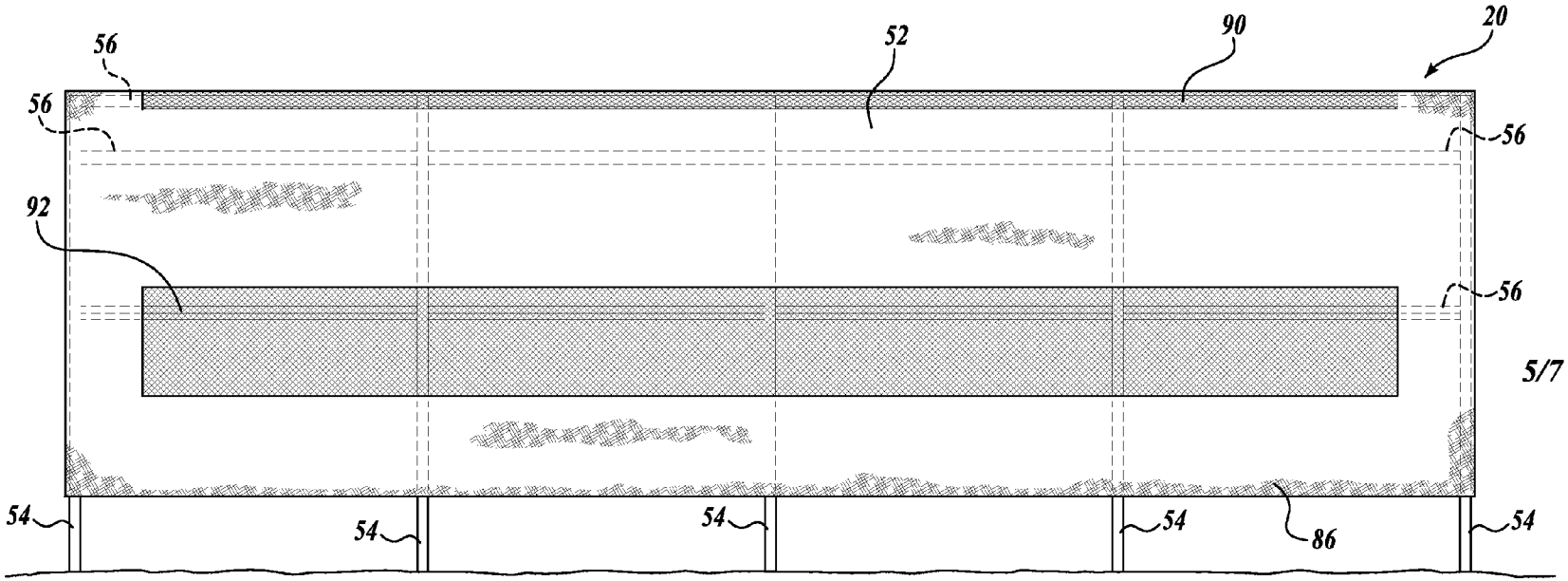
FIG. 5 is a side view of the shade shelter of FIG. 2.

Turning now to FIGS. 2-4, one embodiment of the shade shelter 20 will be described in more detail. As best shown in FIG. 2, the shade shelter 20 may comprise a frame 50 (illustrated in this embodiment as a 180 degree arched frame, although other configurations may be employed) covered with a durable and flexible outer cover 52. In one embodiment, the frame 50 can be lightweight and easy-to-assemble. As shown in FIGS. 2 and 3, the frame 50 may include a plurality of frame supports 54 supported at their opposite ends by a ground surface. The frame supports 54 extend transversely over the ground surface and can be formed, for example, of a plurality of curved components connected end-to-end. The frame supports 54 are vertically aligned, equally spaced apart, and interconnected with adjacent frame supports 54 by horizontally aligned purlins 56. In some embodiments, there are five (5) longitudinally aligned rows of purlins 30. In one embodiment, the frame supports 54 and purlins 56 are constructed out of aluminum rectangular tubing.

Once the frame 50 is assembled, the outer cover 52 is then disposed over the frame supports 54 so as to extend longitudinally and transversely over the frame 50, as best shown in FIG. 2. In one embodiment, contour cables 72 may be attached to the transverse edges 68 and 70 of the outer cover 52. The cables 72 can be routed through transversely extending pouches or sleeves (hidden in FIG. 2) from one respective transverse corner, such as corner 74, to the other respective transverse corner, such as corner 76. In one embodiment, the sleeve may be formed by a folded transverse edge approximately 3-6 inches in depth, and secured via heat bonding, adhesive, stitching, etc. The ends of the contour cables 72 extend outwardly of the outer cover 52 and are attached in a conventional manner to attachment members 80, such as hooks, cleats, etc., staked or otherwise affixed to the ground. In some embodiments, cables 82 may be employed to secure the aligned longitudinal sides 84 and 86 of the outer cover 52 to the purlins 56. Other attachment techniques may be employed to secure the outer cover 52 to the frame 50, including but not limited to grommets/lace, hooks, hook and loop fastening flaps, etc. If desired, optional guy lines (not shown) may be employed to hold down the outer cover 52 and/or to support the frame 50.

Still referring to FIG. 2, the outer cover 52 is of sufficient length to completely extend longitudinally over the erected frame supports 54. Also, the outer cover 52 is of sufficient width to extend transversely over the majority of the erected frame supports 54. In one embodiment, the longitudinal edges of the outer cover 52 are positioned approximately 12-60 inches above ground or other supporting surface. As erected, the frame 50 and outer cover 52 may form an open ended shade shelter having side walls 88 and a roof 94. In the embodiment shown, the side walls 88 and the roof 94 are contiguously curved so as to form a 180 degree arch. However, shade shelters of other shapes and configurations may be employed in embodiments of the present disclosure, one example of which is shown in FIG. 7 and generally designated 120. Additionally, the shade shelter 20 is shown as generally corresponding in shape with the associated shelter 24, but that need not be the case. Non-corresponding shapes between the shade shelter 20 and the shelter 24 may be employed in embodiments of the present disclosure.

The outer cover 52 in one embodiment is made of one or more layers of solid and/or low or non gas permeable material such as a polyester reinforced vinyl fabric, military grade canvas fabrics, nylon fabrics, Cordura® fabrics, military spec. 44103D fabrics, etc. The outer cover 52 includes one or more semi-permeable areas positioned in various locations of the outer cover 52. In that regard, the outer cover 52 in several embodiments includes one or more longitudinally extending areas 90 of mesh, such as vinyl mesh fabric, vinyl coated mesh, nylon mesh, military grade mesh fabric, wire mesh, etc., positioned at or near the crest or apex 90 of the roof 94 of the shade shelter 20. The interstices of the longitudinally extending areas 90 of mesh are sized and configured so as to permit air flow through the outer cover 52, and in some embodiments, the interstices may be of a diamond configuration, hexagonal configuration, rectangular configuration, etc., just to name a few. As will be described in more detail below, the areas 90 may act like a vent to allow hot, rising air to escape through the shade shelter from the space 26, which may in turn, pull cooler air from the bottom of the longitudinal sides and ends of the shade shelter, thereby creating convection sometimes referred to as a chimney effect.

In other embodiments, the outer cover 52 also includes one or more longitudinally extending areas 92 of mesh, such as vinyl mesh fabric, vinyl coated mesh, nylon mesh, military grade mesh fabric, wire mesh, etc., positioned on the sides 84 and 86 of the outer cover 52 at approximately the height of the windows of the associated shelter. In some embodiments, the interstices of the longitudinally extending areas 92 of mesh are sized and configured so as to provide visibility to the occupants of the shelter 24 so that the occupants may see through the windows and out through the outer cover 52. Additionally or alternatively, the interstices of the longitudinally extending areas 92 of mesh are sized and configured so as to permit air flow through the outer cover 52. In some embodiments, the interstices may be of a diamond configuration, hexagonal configuration, rectangular configuration, etc., just to name a few.

In several embodiments, the semi-permeable areas, including areas 90 and/or areas 92, provide between approximately 55-90% solar protection from the sun's rays. In one embodiment, the areas 90 and/or areas 92 provide approximately 85% solar protection from the sun's rays. In these or other embodiments, an optional blackout layer 96 may be attached along the interior surface of the outer cover 52 other than in the semi-permeable areas, which solely, or in combination with the outer cover 52, aid in the prevention of light emission into space 26 (FIG. 1). In one embodiment, the blackout layer 96 is chosen so that the outer cover 52 provides greater than 80% and up to 100% solar protection from the sun's rays. One or more materials that can be employed in the blackout layer include but are not limited to carbon, carbon blends, etc. The outer cover 52 may have a camouflaged exterior color that matches the environment, if desired.

Figure 6:
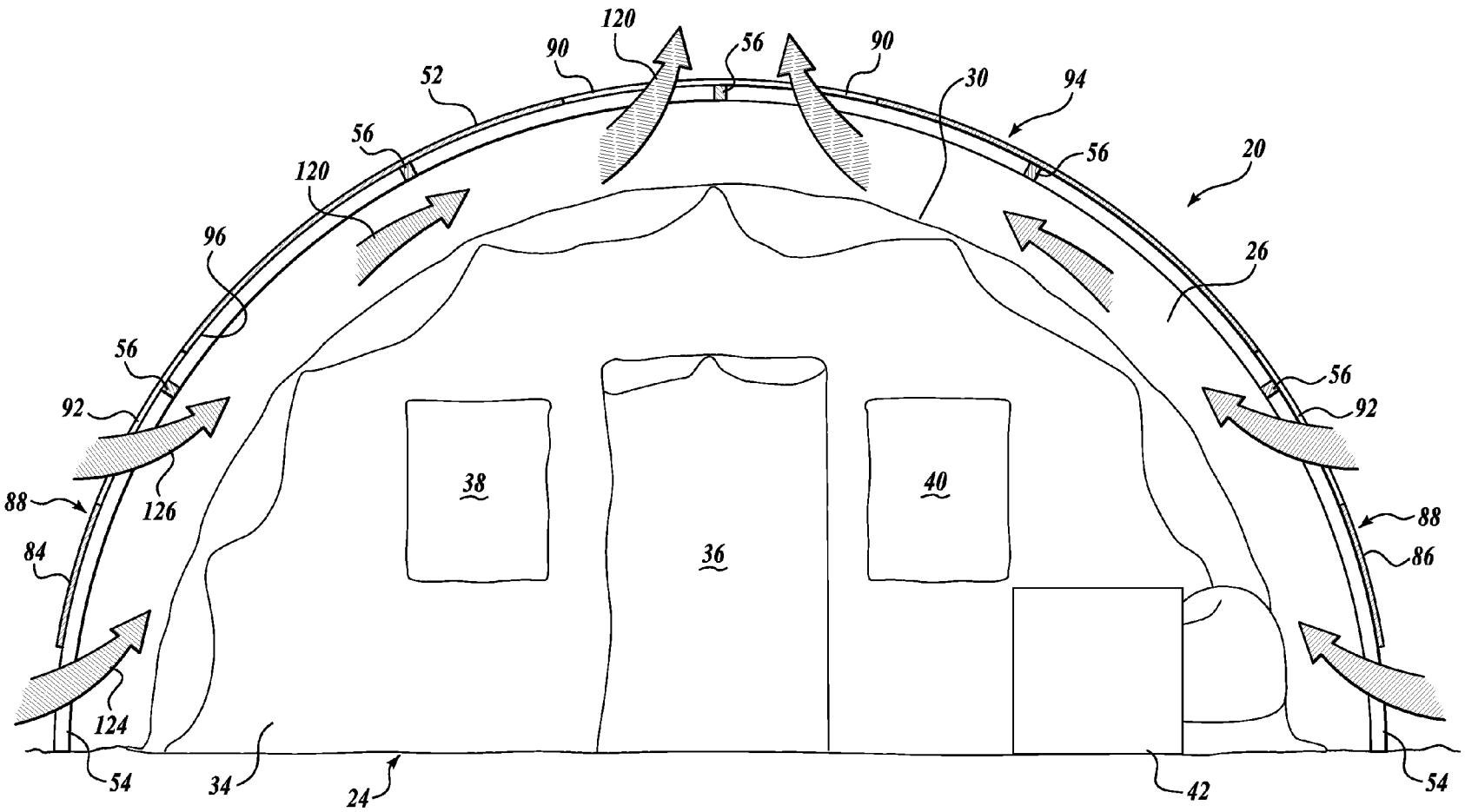
FIG. 6 is a cross sectional view of the shade shelter taken along the lines 6-6 of FIG. 4 and showing the associated temporary shelter in relation thereto.

One operation of the shade shelter 20 will now be described with reference to FIG. 6. As described above, the shade shelter 20 is erected over a shelter 24, creating a contiguous space 26 between the inner surface of the shade shelter 20 and one or more sections of the outer surface of the shelter 24. It will be appreciated that the contiguous space may be broken into a plurality of non-contiguous passageways by the use of vertically positioned spacers or like structure disposed between the shade shelter 20 and the shelter 24, if so desired. In some embodiments, the distance between the inner surface of the shade shelter 20 and one or more sections of the outer surface of the shelter 24 is in the range of between about six (6) inches to about 36 inches.

Once erected, the shade shelter 20 aims to reduce the thermal radiation effects of the sun on the shelter 24. By blocking as much of the suds rays as possible, the outer surface temperature of the outer cover 30 of the shelter 24 is reduced, which results in less heat transfer into the interior space thereof. Additionally, the space 26 delimited by the shade shelter 20 and the shelter 24, the semi-permeable area 90 located at or near the peak of the shade shelter 20, and access to the space 26 from the open ends and/or below the longitudinal edges of the shade shelter form a chimney effect. As a result, the natural convection of heated air (as shown by arrows 120) flows upwardly and escapes or vents through area 90, while cooler air is drawn into the space from below (as shown by arrows 124). Cooler air may also enter the space through areas 92 (as shown by arrows 126). As such, movement of cooler air across the outer surface of outer cover 30 aims to reduce heat transfer into the interior spaces of the shelter. Such reduction of heat transfer into the interior space reduces the air conditioning load needed to maintain the interior space of the shelter at ambient temperatures of, for example, 76-84 degrees Fahrenheit. The semi-permeable areas 90 and 92 may also be configured to allow gusts of wind to pass through the structure, reducing the frame load requirements of the shade shelter 20.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The embodiments of the disclosure in which an exclusive property or privilege is claimed are defined as follows:

1. A system, comprising:

a shelter including a roof, first and second side walls, first and second end walls, and an enclosed interior space; and a portable shade shelter positioned a spaced distance over at least a portion of the shelter so as to create a space between an inner surface of the shade shelter and an outer surface of the shelter, the portable shade shelter opened permanently at one end corresponding to either the first end wall or the second end wall of the shelter to provide access to the space, wherein the shade shelter includes:

a plurality of solid side walls;

a solid roof covering at least a portion of the roof of the shelter; and a vent disposed in the solid roof of the shade shelter for allowing gas flow from the space between the outer surface of the shelter and the inner surface of the shade shelter to an area exteriorly of the roof of the shade shelter.

2. The system of claim 1, wherein the vent includes mesh.

3. The system of claim 2, wherein the mesh extends along a majority of the roof of the shade shelter.

4. The system of claim 1, wherein the vent is located at or near the apex of the roof of the shade shelter.

5. The system of claim 1, wherein the shade shelter further includes a window positionable so as to provide visibility from the shelter to an area located exteriorly of the shade shelter.

6. The system of claim 5, wherein the window includes mesh.

7. The system of claim 1, further comprising an air conditioning unit coupled to the enclosed interior space of the shelter.

8. The system of claim 1, wherein the portable shade shelter includes a frame; and an outer cover supported by at least a majority of the frame.

9. The system of claim 8, wherein the outer cover, when supported by the frame, defines the plurality of solid side walls and the solid roof.

10. The system of claim 8, wherein the outer cover includes sections formed of solid, flexible material and at least one section of mesh, wherein the at least one section of the mesh forms the vent.

11. The system of claim 1, wherein the shade shelter has a second open end corresponding to the other of the first and second side walls of the shelter.

12. The system of claim 1, wherein at least the bottom of the first and second sidewalls of the shelter are supportable by a support surface, and wherein the plurality of solid sidewalls of portable shade shelter includes first and second side walls each including a bottom edge disposed a spaced distance above the bottom of the first and second side walls of the shelter, respectively.

13. A system, comprising:

a shelter including a roof, at least first and second side walls, and an enclosed interior occupiable space, the bottoms of the at least first and second side walls being supportable by a support surface;

a shade shelter supported a spaced distance over at least a portion of the shelter, wherein the shade shelter includes a frame and a solid outer cover supported by at least a majority of the frame, which together form a plurality of side walls each having a bottom edge and a roof covering at least a portion of the roof of the shelter; and a passageway that extends between the shade shelter and the shelter;

wherein the solid outer cover includes a section of mesh positioned at or near the apex of the roof, the section of mesh acting as a vent so as to allow gas flow from the passageway to an area exteriorly of the roof of the shade shelter, and wherein the bottom edges of the plurality of side walls of the shade shelter are disposed a spaced distance above the bottom of the at least first and second side walls of the shelter, respectively, thereby providing access to the passageway.

14. The system of claim 13, wherein the outer cover, when supported by the frame, forms an arch, and wherein the vent is position at or near the apex of the arch.

15. The system of claim 13, wherein the shade shelter further includes a window positionable so as to provide visibility from an associated shelter to an area located exteriorly of the shade shelter.

16. The system of claim 13, further comprising an air conditioning unit coupled to the enclosed interior occupiable space of the shelter.

17. The method of claim 16, wherein the portable shade shelter includes a frame; and an outer cover supported by at least a majority of the frame.

18. The method of claim 17, wherein the outer cover, when supported by the frame, defines the plurality of side walls, the roof, and the opening.

19. The method of claim 17, wherein the outer cover includes sections formed of solid, flexible material and at least one section of mesh, wherein the at least one section of the mesh forms the vent.

20. The method of claim 19, wherein the vent is located at or near the apex of the roof of the shade shelter.

21. A method of reducing the air conditioning loads of a shelter, comprising:

obtaining a shelter that includes a roof, two or more side walls, an enclosed interior occupiable space, and at least one air conditioner configured for conditioning the enclosed interior occupiable space;

erecting a portable shade shelter a spaced distance over at least a portion of the shelter so as to create a space between an inner surface of the shade shelter and an outer surface of the shelter and an opening at one end of the portable shade shelter to provide access to the space, wherein the shade shelter includes:

a plurality of side walls supportable by a surface;

a roof contiguously associated with the plurality of side walls; and a vent disposed in the roof so as to provide gas flow communication between the space and an area exteriorly of the roof of the shade shelter.

* * * * *

UNITED STATES PATENT AND TRADEMARK OFFICE

CERTIFICATE OF CORRECTION

PATENT NO. : 8,549,794 B2
APPLICATION NO. : 13/294979
DATED : October 8, 2013
INVENTOR(S) : D. Hotes It is certified that error appears in the above-identified patent and that said Letters Patent is hereby corrected as shown below:

On the Title Page

| | | |
|---|---|---|
| (73) Pg. 1, col. 1 | Assignee | "**California Industrial Facilities Resources, Inc.**, Kirkland, WA (US)" should read |
| | | --**California Industrial Facilities Resources, Inc., dba CAMSS Shelters**, Kirkland, WA (US)-- |

Signed and Sealed this
First Day of April, 2014

Michelle K. Lee

Michelle K. Lee
*Deputy Director of the United States Patent and Trademark Office*